US011454031B2

(12) United States Patent
Horner et al.

(10) Patent No.: US 11,454,031 B2
(45) Date of Patent: Sep. 27, 2022

(54) INSULATION PLATE PLACEMENT TOOL AND METHOD OF OPERATION THEREOF

(71) Applicant: Everhard Products, Inc., Canton, OH (US)

(72) Inventors: Andrew J Horner, Canton, OH (US); Roy S Ailstock, Uniontown, OH (US)

(73) Assignee: EVERHARD PRODUCTS, INC., Canton, OH (US)

( * ) Notice: Subject to any disclaimer, the term of this patent is extended or adjusted under 35 U.S.C. 154(b) by 10 days.

(21) Appl. No.: 17/227,945

(22) Filed: Apr. 12, 2021

(65) Prior Publication Data

US 2021/0230877 A1 Jul. 29, 2021

Related U.S. Application Data

(62) Division of application No. 16/452,702, filed on Jun. 26, 2019, now Pat. No. 10,982,448.

(51) Int. Cl.

| | |
|---|---|
| ***E04B 1/00*** | (2006.01) |
| ***E04D 15/04*** | (2006.01) |
| ***E04D 11/02*** | (2006.01) |

(52) U.S. Cl.

CPC ..... *E04D 15/04* (2013.01); *E04D 11/02* (2013.01); *E04D 2015/042* (2013.01)

(58) Field of Classification Search

CPC .... E04D 11/02; E04D 15/04; E04D 2015/042
USPC ..... 52/741.4
See application file for complete search history.

(56) References Cited

U.S. PATENT DOCUMENTS

| | | | | |
|---|---|---|---|---|
| 1,757,529 | A * | 5/1930 | Jones | B66C 1/0231 294/187 |
| 2,493,108 | A | 1/1950 | Casey | |
| D195,589 | S * | 7/1963 | Chamiga | D8/71 |
| 3,240,525 | A * | 3/1966 | Wood | B65G 49/061 294/185 |
| 3,374,022 | A * | 3/1968 | Tagg | A45B 3/00 294/23 |
| 4,073,530 | A | 2/1978 | Seidler | |
| 4,105,239 | A * | 8/1978 | Akczinski, Sr. | B03C 1/0332 294/210 |
| 4,583,343 | A * | 4/1986 | Camp | E04F 21/20 52/749.11 |
| 4,726,263 | A | 2/1988 | Lake | |
| 4,813,729 | A | 3/1989 | Speckhart | |
| 4,850,133 | A | 7/1989 | Burzdak et al. | |

(Continued)

OTHER PUBLICATIONS

Prior Art Applicator Tool, in use prior to Jun. 1, 2018, one page.

*Primary Examiner* — Basil S Katcheves
(74) *Attorney, Agent, or Firm* — Sand, Sebolt & Wernow Co., LPA

(57) ABSTRACT

A hand tool for placing a single insulation plate at one time atop an insulation board or a vapor barrier or membrane on a flat or low slope roof. The hand tool has a flexible member that carries a releasable connector having a grip strength that releasably retains one insulation plate. The flexible member flexes between a neutral first position and a flexed second position. When the flexible member is flexed towards the second position, the releasable connector releases the insulation plate to place the insulation plate in a desired location atop the insulation board or vapor barrier on the flat or low slope roof.

18 Claims, 8 Drawing Sheets

(56) References Cited

U.S. PATENT DOCUMENTS

| | | | | |
|---|---|---|---|---|
| 5,639,134 | A * | 6/1997 | Rusch | B25G 1/10 294/187 |
| 5,647,622 | A | 7/1997 | Schectman | |
| 5,692,417 | A | 12/1997 | Irpino | |
| 6,039,371 | A | 3/2000 | Smith | |
| 6,230,592 | B1 | 5/2001 | Hsiao | |
| 6,394,712 | B1 | 5/2002 | Weinstein et al. | |
| 6,669,024 | B2 | 12/2003 | Ottens | |
| 6,729,522 | B2 * | 5/2004 | Hempfling | B25B 23/10 227/139 |
| 7,047,586 | B2 * | 5/2006 | Shimada | A47L 13/24 15/228 |
| 7,631,579 | B2 | 12/2009 | Johnson et al. | |
| 7,900,420 | B2 | 3/2011 | Pope | |
| 8,827,335 | B2 * | 9/2014 | Tortelli | B65D 25/10 294/212 |
| 9,016,739 | B2 | 4/2015 | Mondano et al. | |
| 9,452,514 | B2 | 9/2016 | Guthrie et al. | |
| 10,022,875 | B1 * | 7/2018 | Cowan | B25J 15/0608 |
| 2003/0173788 | A1 | 9/2003 | Fussell et al. | |
| 2005/0178246 | A1 | 8/2005 | Johnson et al. | |
| 2012/0079921 | A2 | 4/2012 | Monahan | |
| 2014/0161561 | A1 | 6/2014 | Tebo | |
| 2016/0221164 | A1 | 8/2016 | Walters et al. | |

* cited by examiner

INSULATION PLATE PLACEMENT TOOL AND METHOD OF OPERATION THEREOF

CROSS REFERENCE TO RELATED APPLICATIONS

The present disclosure is a divisional of U.S. patent application Ser. No. 16/452,702, filed Jun. 26, 2019, the entirety of which is incorporated herein by reference.

TECHNICAL FIELD

The present disclosure relates generally to roofing hand tools. More particularly, the present disclosure relates to a hand tool for placing a single insulation plate at one time atop an insulation board or a vapor barrier or membrane on a flat or low slope roof. The hand tool has a flexible member that carries a releasable connector having a grip strength that releasably retains one insulation plate. The flexible member flexes between a neutral first position and a flexed second position. When the flexible member is flexed towards the second position, the releasable connector releases the insulation plate to place the insulation plate in a desired location atop the insulation board or vapor barrier on the flat or low slope roof.

BACKGROUND

Flat or low slope metal roofs provide years of low cost, low maintenance performance. Flat or low slope metal roofs have been a preferred roof covering for commercial, institutional and industrial buildings for years because of their ability to protect against the elements, to allow water to drain away from the roof surface, and to keep building contents and occupants dry and comfortable.

Flat or low slope metal roofs often have a corrugated metal base layer that is supported by trusses or other structural supports carried by the building. The corrugated metal is a poor thermal insulator and thus insulation is typically laid over the corrugated metal. The insulation may be any type of insulation, however, in commercial applications, the insulation is often a foam board having a desired R-value, often R-16 or greater.

There are many ways to connect the foam board insulation to the corrugated metal. One common manner to connect the foam board insulation to the corrugated metal is through the use of an elongated nail or screw that extends through the foam board insulation and into/through the corrugated metal.

High winds moving atop the flat room have a tendency to create lift or upward forces that can separate the foam board insulation from the corrugated metal. To combat the lift forces imparted by winds blowing above the flat roof, circular plates having a central aperture are used in conjunction with the nail or screw to act similar to that of a washer. The circular plates increase the effective surface area of the connector (i.e., the nail or screw) to spread the force over a larger surface area to reduce the likelihood that the foam board insulation will pull through the connector. The circular plates are often referred to as insulation plates in the commercial roofing industry.

The insulation plates are often three inch round Galvalume-coated metal plates with reinforcing ribs that define a central aperture to resist wind uplift. Some non-limiting and exemplary dimensions associated with the insulation plates include: outer diameter (OD): 3 inch Round; inner diameter (ID): 0.258 inch nominal; thickness: 0.017 inch nominal; finish: AZ50 Galvalume; and weight about 14 or 15 grams (about 0.5 ounce).

To place the insulation plates on the roof, there are two currently known methods (i.e., placement actions). First, there is a commercially available machine that can drive along the flat roof and place one insulation plate at a time. However, this machine is heavy and burdensome move it up onto the flat roof. Further, it requires electrical power, which is often a limited commodity on a flat roof as other workmen need electrical outlets for their other power tools.

The second placement action is more effective and is simply a manual placement of the insulation plate. This requires that a roofer or workman place each individual insulation plate in the desired installation location atop the foam board. Because the insulation plates are applied to the foam board in relatively short intervals about 2 feet apart or less, this often results in the roofer having to crawl or shuffle on their knees atop the foam board. However, given the large scale of flat roofs for commercial structures, this placement action is often tedious and strenuous on the roofer that must crawl on their knees over the entire flat or low slope roof.

When foam board insulation insulates a metal roof, a vapor barrier or membrane must also be used to prevent moisture from penetrating or seeping to the foam board insulation. There are many ways in which the vapor barrier or membrane can be secured to the top of the foam board insulation. One preferred manner is to re-use the insulation plates and screw the vapor barrier to the foam board insulation. Alternatively, the vapor barrier or membrane may be placed with an installation plate having a slightly smaller diameter, typically about 2 inches. Thus, the insulation plates may be placed both atop the foam board insulation and atop the vapor barrier or membrane.

When the roofer performs the manual placing action of the insulation plates, he will often crawl on his hands and knees over the entire roof placing the insulation plates on the foam board and screwing the foam board to the corrugated metal. Then, after the foam board insulation is secured to the corrugated metal, the vapor barrier or membrane is applied over the foam board insulation and the roofer must then again crawl on his knees over the entire flat roof placing a second set of insulation plates atop the vapor barrier or membrane for attachment with the foam board insulation.

One can readily understand that having a roofer or workman crawl on his hands and knees, twice, placing insulation plates atop a large flat or low slope roof is an onerous process.

SUMMARY

A need continues to exist for an improved device and method for installing or placing insulation plates on a portion of a roof. The present disclosure addresses these and other issues by providing a hand tool that will eliminate the need for a roofer, operator, or workmen from crawling on his hands and knees on a roof, but in which the placement of the insulation plates is still manually performed so that an electrical machine need not be used to the place/install the insulation plates.

In one aspect, an exemplary embodiment of the present disclosure may provide a hand tool for placing an insulation plate atop a roof insulation board or vapor barrier or membrane, the hand tool comprising: a distal end opposite a proximal end defining a longitudinal axis; a flexible member adjacent the distal end that flexes in a flex direction; a releasable connector in operative communication with the flexible member adapted to place a single insulation plate atop a roof insulation board or vapor barrier or membrane during one insulation plate placement action that flexes the flexible member in the flex direction; and an elongated handle that is generally rigid relative to the flex direction. This exemplary embodiment or another exemplary embodiment may further provide a pole handle coupled to the flexible extension, the pole handle extending along the longitudinal axis towards the proximal end. This exemplary embodiment or another exemplary embodiment may further provide a first end of the flexible member; a second end of the flexible member; wherein the first end of the flexible member defines the distal end. This exemplary embodiment or another exemplary embodiment may further provide a first surface of the flexible member extending from the first end to the second end. This exemplary embodiment or another exemplary embodiment may further provide a second surface of the flexible member; a neutral first position of the flexible member and a flexed second position of the flexible member; wherein the releasable connector is on the first surface; and wherein the first surface is convex and the second surface is concave when the flexible member is in the flexed second position. This exemplary embodiment or another exemplary embodiment may further provide a second surface of the flexible member parallel the first surface; two sidewalls on the flexible member extending between the first surface and the second surfaces; and wherein the flexible member is square or rectangular in cross section. This exemplary embodiment or another exemplary embodiment may further provide wherein the first and second surfaces define major surfaces of the flexible member and the two sidewalls define minor surfaces of the flexible member, wherein the flexible member flexes relative to the major surfaces. This exemplary embodiment or another exemplary embodiment may further provide wherein the releasable connector is connected to the first surface of the flexible member. This exemplary embodiment or another exemplary embodiment may further provide wherein the first surface of the flexible member is offset parallel to the longitudinal axis. Or, wherein the exterior surface of the releasable member is offset from the first surface of the flexible member and positioned farther from the longitudinal axis than the first surface. This exemplary embodiment or another exemplary embodiment may further provide wherein the releasable connector is a magnet. This exemplary embodiment or another exemplary embodiment may further provide wherein the releasable connector is offset to one side of the longitudinal axis and the releasable connector intersects the longitudinal axis as the flexible member flexes from the neutral first position towards the flexed second position, and/or wherein the releasable connector is offset to an opposite side of the longitudinal axis in the flexed second position. This exemplary embodiment or another exemplary embodiment may further provide an exterior surface of the releasable connector having a grip strength that is greater than the weight of one insulation plate and less than the weight of two insulation plates. wherein the exterior surface of the releasable member is offset from the first surface of the flexible member and positioned farther from the longitudinal axis than the first surface a Shore A hardness of the flexible member in a range from 30 to 50, and in one particular embodiment the Shore A hardness of the flexible member is about 40. This exemplary embodiment or another exemplary embodiment may further provide wherein the flexible member consists essentially of neoprene. This exemplary embodiment or another exemplary embodiment may further provide a dimension of the releasable connector aligned along the longitudinal axis; a length of the flexible member aligned along the longitudinal axis; a ratio of the length of the flexible member to the dimension of the releasable that is greater than 3:1, and in one particular embodiment the ratio is at least 8:1.

In another aspect, an exemplary embodiment of the present disclosure may provide a hand tool for placing an insulation plate atop a flat or low slope roof insulation board or vapor barrier or membrane, the hand tool comprising: a distal end opposite a proximal end defining a longitudinal axis; a pole handle connected to the flexible extension, the pole handle extending along the longitudinal axis towards the proximal end, and a grip on the pole handle defining the proximal end and circumscribing an exterior surface of the pole handle, wherein the pole handle is hollow along a length thereof and is centered along the longitudinal axis, wherein the length of the pole handle is in a range from about 24 inches to about 48 inches, and the pole handle is circular in cross section; a flexible member including a first end and a second end, wherein the first end defines the distal end, and including a first surface, a second surface, a first sidewall and a second sidewall each extending from the first end to the second end, wherein the first surface is parallel to the second surface and orthogonal to the first and second sidewalls such that the flexible member is a hyper-rectangle member that is square or rectangular in cross section, and wherein the first and second surfaces define major surfaces of the flexible member and the first and second sidewalls define minor surfaces of the flexible member, and the flexible member having a Shore A hardness in a range from 30 to 50 and consisting essentially of neoprene; a bracket connecting the second end of the flexible member to the pole handle opposite the grip, and the bracket defining a slot sized complementary to the a dimension of the flexible member measured from the first surface to the second surface; a neutral first position of the flexible member and a flexed second position of the flexible member, wherein the longitudinal axis extends centrally between parallel first and second surfaces of the flexible member in the neutral first position, wherein the first surface is convex and the second surface is concave when the flexible member is in the flexed second position, and the second surface flexes at most 90 degrees between the neutral first position and the flexed second position, and wherein the flexible member flexes relative to the major surfaces and in response to contacting the insulation plate to a flat or low slope roof vapor barrier or membrane; and a releasable connector connected with the flexible member for releasable retaining and placing the insulation plate atop the flat or low slope roof vapor barrier or membrane, wherein the releasable connector is a ceramic magnet having an exterior surface offset from the first surface of the flexible member farther from the longitudinal axis than the first surface, and the ceramic magnet having a grip strength that is greater than the weight of one insulation plate and less than the weight of two insulation plates; and a dimension of the ceramic magnet aligned along the longitudinal axis, and a length of the flexible member measured from the first end to the second aligned along the longitudinal axis, and a ratio of the length of the flexible member to the dimension of the releasable that is greater than 3:1, wherein the ratio is adapted ensure that a rigidity of the ceramic magnet does not inhibit the flexibility of the flexible member.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
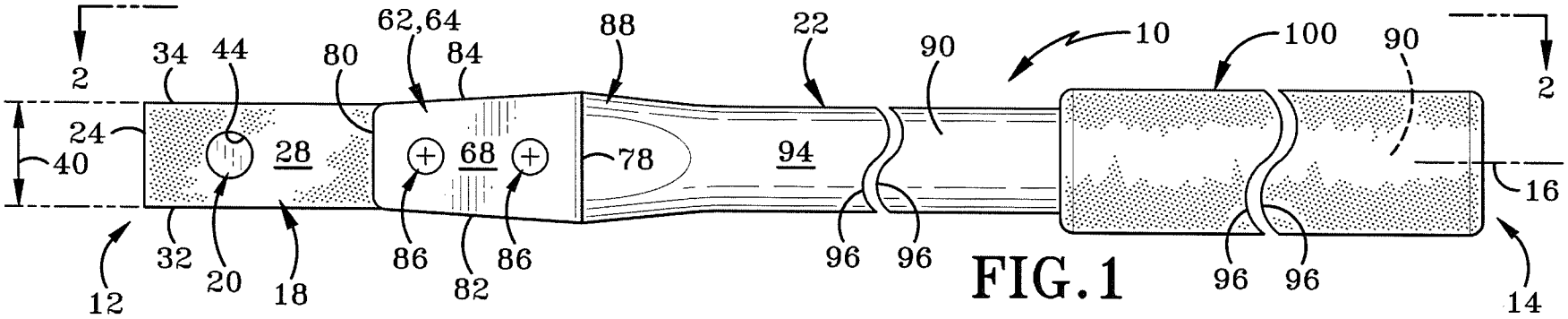
FIG. 1 (FIG. 1) is a bottom plan view of a hand tool for placing an insulation plate in accordance with the present disclosure.
Figure 2:
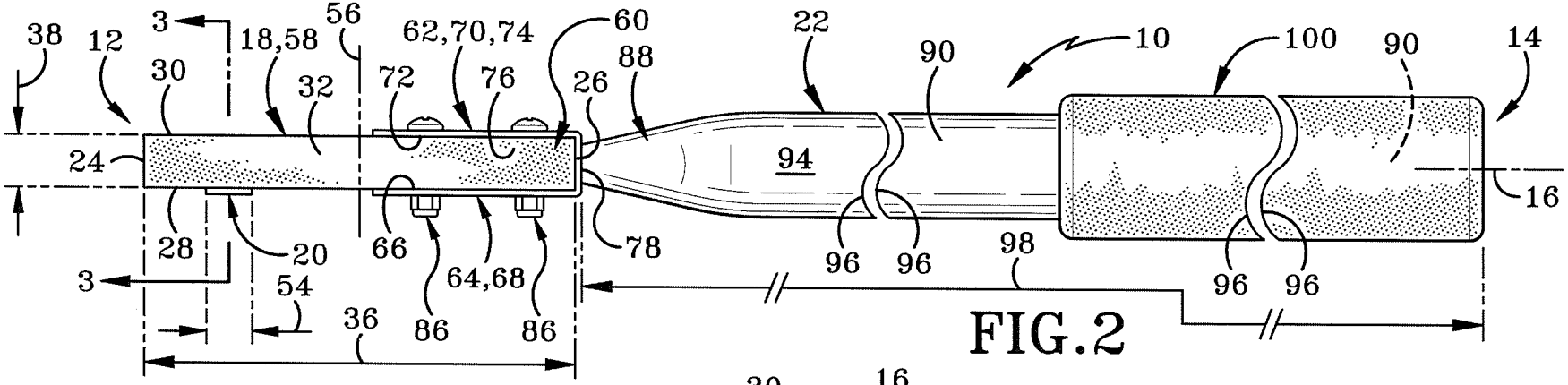
FIG. 2 (FIG. 2) is a side view of the hand tool for placing the insulation plate taken along line 2-2 in FIG. 1.
Figure 3:
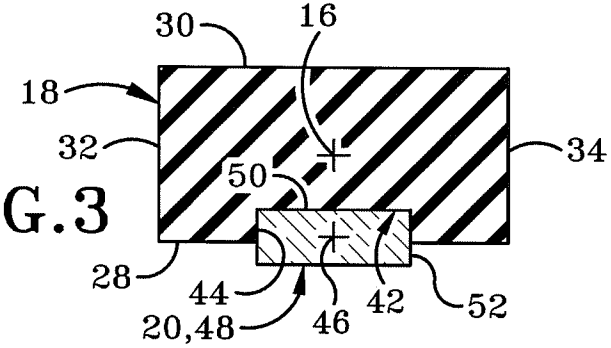
FIG. 3 (FIG. 3) is a cross section view of a releasable member connected to a flexible member on the hand tool for placing the insulation plate taken along line 3-3 in FIG. 1.

FIG. 1-FIG. 3 depict a hand tool for placing an insulation plate atop or along an upper surface of an insulation foam board or a vapor barrier or membrane for a roof is shown generally at 10. The hand tool 10 is sized to be carried by an operator (or roofer/workman) and to configured to manually install or place one insulation plate at a time onto the vapor barrier/membrane while walking on the roof and eliminating the need for the operator to crawl on his knees to the next plate placement location.

The hand tool 10 includes a distal end 12 opposite a proximal end 14 defining a longitudinal axis 16 extending therebetween. Some aspects of the hand tool 10 will be described relative to the longitudinal axis 16. For example, cross sections of some regions of hand tool 10 may be taken transversely through the longitudinal axis 16.

Figure 4:
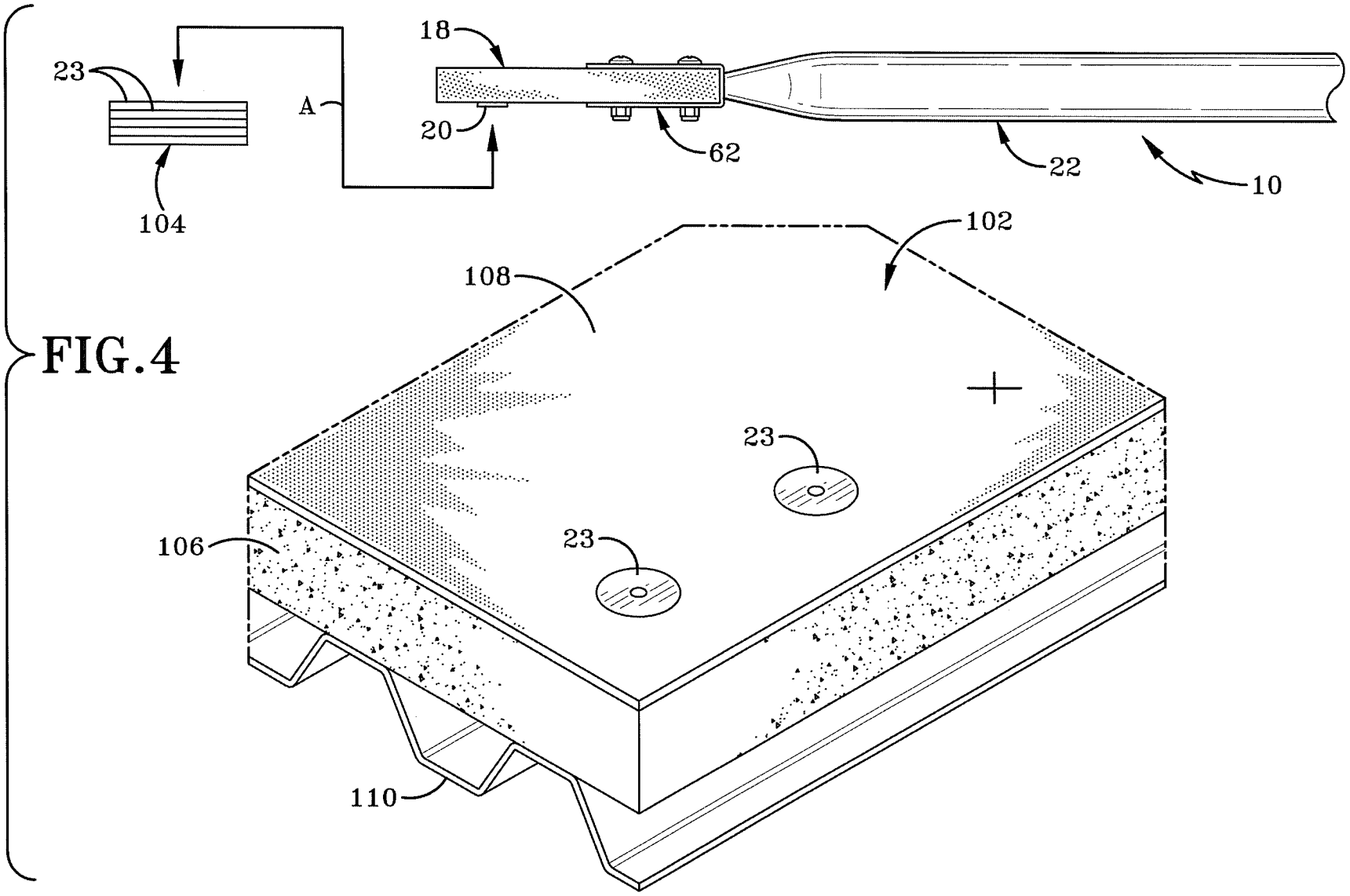
FIG. 4 (FIG. 4) is a diagrammatic view of the hand tool and a plurality of insulation plates that are to be placed on a flat or low slope roof.

Hand tool 10 may include a flexible member 18, a releasable connector 20, and a handle or pole handle 22. The releasable connector 20 is carried by the flexible member 18 and is configured to releasably connect with one insulation plate 23 (FIG. 4) at a time for placement and installation atop the foam board insulation or vapor barrier or membrane on the roof, which may be flat or of low slope.

The flexible member 18 includes a first end 24 and a second end 26. The first end 24 of the flexible member 18 defines the distal end 12 of hand tool 10. The first and second ends 24, 26 of the flexible member 18 intersect the longitudinal axis 16. In one particular embodiment, the first and second ends 24, 26 orthogonally intersect the longitudinal axis 16. Flexible member 18 further includes a first surface 28 opposite a second surface 30. The first surface 28 and the second surface 30 extend between the first end 24 and the second end 26. In one particular embodiment, the first surface 28 is parallel to the second surface 30. Further, the longitudinal axis 16 may extend centrally between the first surface 28 and the second surface 30.

The flexible member 18 may further include a first sidewall 32 opposite a second sidewall 34. The first sidewall 32 and the second sidewall 34 extend between the first end 24 and the second end 26. In one particular embodiment, the first sidewall 32 and the second sidewall 34 may be offset parallel to each other and orthogonal to the first surface 28 and the second surface 30. The longitudinal axis 16 extends centrally between the first sidewall 32 and the second sidewall 34. The flexible member 18 may be formed in the shape of a hyper-rectangle. In one particular embodiment, the flexible member 18 may be either square or rectangular in cross section as viewed transversely through the longitudinal axis 16.

A length 36 of the flexible member 18 is aligned along the longitudinal axis 16 and is measured from the first end 24 to the second end 26. The length 36 of the flexible member 18 may be in a range from about two inches to about six inches. In one particular embodiment the length 36 of the flexible member 18 is about four inches. A thickness or height 38 of the flexible member 18 is aligned transverse to the longitudinal axis 16 and is measured from the first surface 28 to the second surface 30. The thickness or height 38 of the flexible member may be in a range from about ¼ inch to about ¾ inch. In one particular embodiment, the thickness or height of the flexible member 18 is about ½ inch. A width 40 of the flexible member 18 is aligned transverse to the longitudinal axis 16 and orthogonal to the height 38. The width 40 is measured from the first sidewall 32 to the second sidewall 34. The width 40 of the flexible member 18 may be in a range from about ½ inch to about 1.5 inches. In one particular embodiment, the width 40 of the flexible member 18 is about one inch.

In one particular embodiment, the first surface 28 and second surface 30 may define major surfaces of the flexible member 18, and the first sidewall 32, the second sidewall 34, the first end 24, and the second end 26 may define minor surfaces the flexible member. However, if the flexible member 18 is square in cross section, then there may not be major and minor surface but rather four equal surfaces excluding the ends 24, 26.

Figure 7:
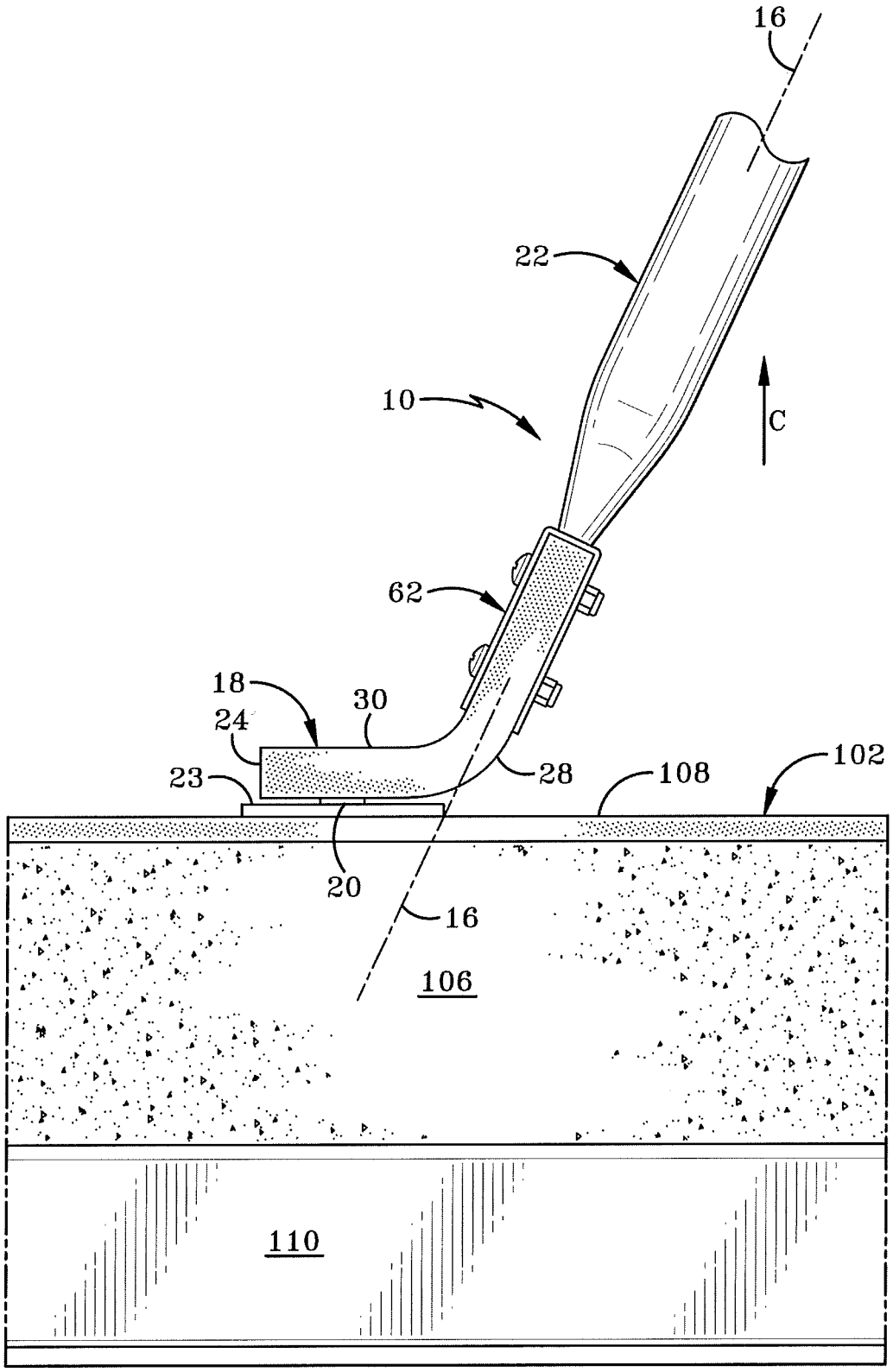
FIG. 7 (FIG. 7) is an operational diagrammatic view of the hand tool placing one insulation plate on a flat or low slope roof and the flexible member in a flexed second position.

The flexible member 18 is formed from a material that enables it to flex between a neutral or home first position (as shown in FIG. 1 and FIG. 2) and a flexed second position (as shown in FIG. 7). In one particular embodiment, the material forming the flexible member 18 has a Shore A hardness in a range from about 30 to about 50. In one particular embodiment, an exemplary Shore A hardness of the flexible member 18 is about 40. In this exemplary embodiment, the range of the Shore A hardness may be advantageous or critical to ensure that the flexible member 18 bends, flexes, or otherwise curves in a precise manner to ensure that a single insulation plate may be installed or placed atop a vapor barrier/membrane on a flat roof but also does not flex or bend while carrying the weight of one insulation plate 23. If the Shore A hardness is too rigid, the flexible member 18 will not sufficiently flex, bend, or curve to correctly place the single roof placed in a desired location. Namely, an overly rigid flexible member may cause the single roof place to not be able to laid flat on the flat roof. If the Shore A hardness is too flaccid, the flexible member may overly flex, bend, or curve such that the flexible member is too floppy and cannot be adequately controlled, thus making it difficult to correctly place the single insulation plate 23 on the flat or low slope roof. The flexible member 18 is flexed relative to a flex direction.

The material forming the flexible member 18 may be a unibody that is integrally extruded, molded, printed, or additively manufactured, removably machined, or formed as a unitary, monolithic member substantially fabricated from a substantially flexible or semi-flexible, natural or manmade, material. In one example, am elastomeric flexible polymer or rubber material (synthetic or natural) is resilient and withstands inadvertent deformation to resiliently return to its basic hyper-rectangular configuration. This resilient material forms a substantial majority of the components or elements used to fabricate the flexible member 18. The flexible member 18 should withstand typical roofing usage and forces from a workman/operator maneuvering the hand tool 10 atop the roof. While it is contemplated that the flexible member 18 is uniformly and integrally extruded, molded, or formed, it is entirely possible that the components of the flexible member 18 be formed separately from alternative materials as one having routine skill in the art would understand.

In one particular embodiment, the material forming the flexible member 18 may be neoprene (also referred to as polychloroprene or pc-rubber), or another synthetic rubber. In other embodiments, the flexible member 18 may comprise, consists essentially of, or consist of neoprene. Other materials forming the flexible material 18 can be selected from compositions that are produced by polymerization of chloroprene. Neoprene exhibits good chemical stability and maintains flexibility over a wide temperature range. The neoprene of the flexible material is a solid rubber even though neoprene may sometimes be commercially sold in latex form. Alternatively, the material forming the flexible material may also be selected from EPDM, silicone rubber, viton, natural rubber, nitrile rubber, butyl rubber, or timprene, synthetic rubber, sponge rubber, foam rubber, flexible PVC, thermoplastic elastomers (TPE), ManniGlas, or Fiber-Frax.

In one particular embodiment, the first surface 28 may define a shallow recess 42 extending inwardly towards the longitudinal axis. The shallow recess 42 may be bound by an inner edge 44 positioned between the outer edges of the flexible member 18 defined by the intersection of the first surface 28 and the first and second sidewalls 32, 34, respectively. In one particular embodiment, the shallow recess 42 is centered between the first and second sidewalls 32, 34 such that the center 46 of the shallow recess is coplanar with the longitudinal axis 16.

The releasable connector 20 may be carried by the flexible member 18. In one particular embodiment, the releasable connector 20 is secured to the flexible member 18. More particularly, the releasable connector 20 may be secured to the first surface 28 of the flexible member 18. In one specific embodiment, the releasable connector 20 is inserted into the shallow recess 42 and secured to the flexible member 18. In some instances, an outer surface 48 of the releasable connector 20 may be offset from the first surface 28. However, in other instances, the releasable connector 20 has an outer surface 48 that is coplanar with the first surface 28 of the flexible member 18.

Although the first surface 28 is depicted as forming the shallow recess 42 that receives the releasable connector 20, it is possible for alternative embodiments to provide the first surface 28 of the flexible member 18 as substantially flat, planar, continuous and uninterrupted. In this instance the releasable connector 20 may be connected to the flat first surface 28 of the flexible member 18 via a mechanical securement, a chemical securement, or a non-mechanical and non-chemical securement. In this instance, an inner surface 50 of the releasable connector would be directly connected or applied to the first surface 28 of the flexible member 18.

The releasable connector 20 includes the outer surface 48 and the inner surface 50 and a sidewall 52 of the releasable connector 20 that is defined by a thickness of the releasable connector 20 between the outer surface 48 and the inner surface 50. The thickness of the releasable connector is aligned parallel with the direction in which the height of the flexible member 18 is aligned. The releasable connector 20 includes, when viewed in cross section, a distal first end and a proximal second end defining a length 54 of the releasable connector 20 therebetween. In one particular embodiment, the length 54 of the releasable connector 20 is aligned parallel to the length 36 of the flexible member 18. A ratio of the length 36 of the flexible member 18 to the length 54 of the releasable connector 20 may be greater than about 3:1. In one particular embodiment, the ratio of the length 36 of the flexible member 18 relative to the length 54 of the releasable connector 20 is about 8:1. Stated otherwise, the length 36 of the flexible member 18 is about eight times greater than the length 54 of the releasable connector 20. In accordance with an exemplary aspect, the ratio of the length 36 of the flexible member 18 relative to the length 54 of the releasable connector 20 being about 8:1 is adapted ensure that a rigidity of the releasable connector 20 (which may be a ceramic magnet) does not inhibit the flexibility of the flexible member 18. Thus, while other ratios are available, the 8:1 ratio may be advantageous when the Shore A hardness of the flexible member is in a range from about 30 to about 50.

In one particular embodiment, the releasable connector 20 may be oriented as offset towards the first end 24 of the flexible member 18 relative to an imaginary vertical midline 56 of the flexible member 18. Stated otherwise, the imaginary vertical midline 56 delineates the flexible member 18 into a distal first half 58 and a proximal second half 60. The releasable connector 20 may be disposed entirely within the first half 58 of the flexible member 18 and distally from the imaginary vertical midline 56 of the flexible member 18. In one particular embodiment, the center 46 of the releasable connector 20 maybe located approximately halfway between the first end 24 of the flexible member 18 and the imaginary vertical midline 56. Stated otherwise, the releasable connector 20 may be positioned approximately one-quarter length from the first end 24 of the flexible member 18 and approximately three-quarter length from the second end 26 of the flexible member 18.

The releasable connector 20 has a grip strength that effectuates its ability to pick up, grasp, or otherwise releasably retain a single insulation plate 23 at one time. With respect to the releasable connector 20, the term grip strength refers to an amount of force exerted or applied from the releasable connector 20 to pick up, grasp, or releasably retain one single insulation plate 23. In accordance with the present disclosure, the grip strength of the releasable connector 20 is greater than the weight of one insulation plate 23 but less than the weight of two insulation plates. As will be described in greater detail below, the grip strength enables the releasable connector 20 to pick up, grasp, or otherwise retain a single insulation plate 23 during a placement/installation action, but not pick up more than one insulation plate (i.e., two or more) at one time. Thus, in accordance with one aspect of the present disclosure, the grip strength may have a critical range to exert a force to pick up, grasp, or otherwise retain only one insulation 23 plate at a single time. In one example, the weight of one exemplary insulation plate 23 is approximately fourteen or fifteen grams or approximately 0.5 ounce. Thus, the weight of the two exemplary insulation plates is approximately 28-30 grams or about one ounce. In this instance, the grip strength of the releasable connector 20 should equate to a force that is greater than about 14 or 15 grams (about 0.5 ounce) but less than about 28 to 30 grams (about one ounce).

In one particular embodiment, the releasable connector 20 is a ceramic magnet that is disc-shaped or cylindrical plinth-shaped. In this instance, the length 54 of the releasable connector 20 equals the diameter of the cylindrical magnet. The inventors have determined that a ceramic member may be preferable to some embodiments inasmuch as ceramic magnets are readily commercially available and relatively low cost. Further, a ceramic magnet is able to exert the grip strength force for a sufficiently long time such that the hysteresis of the magnet should not diminish (i.e., demagnetize) over the life of the hand tool 10.

Other types of releasable connectors 20 are possible, however. For example, the releasable connector 20 may be a conventional releasable sticky-tack adhesive having a grip strength that is greater than the weight of a single insulation plate. When the releasable connector 20 is embodied as a releasable sticky-tack adhesive, it is possible for the grip strength of the sticky-tack adhesive to exceed the weight of two insulation plates. However, because the sticky-tack adhesive would only be contacting one plate 23 at a time, a second insulation plate should not be inadvertently picked up by the releasable connector during the placement or installation action, as would be the case when the releasable connector is embodied as a magnet. One non-limiting and exemplary releasable sticky-tac adhesive is Blu Tack produced by Bostik. In this instance, the releasable sticky-tack adhesive may be a reusable putty-like pressure-sensitive adhesive.

When the flexible member 18 is in the neutral first position, the releasable connector 20 is offset to one side of the longitudinal axis 16. As will be described in greater detail below, as the flexible member 18 is flexed or bent to install or place the insulation plate 23 atop the roof, the flexible member 18 bends towards the flexed second position. During the flexion or bending of the flexible member 18, the releasable connector 20 crosses or intersects the longitudinal axis 16. When the flexible member is fully flexed into the flexed second position, at least a portion of the releasable connector 20 will be positioned on the other side of the longitudinal axis 16 than it was prior to the flexion of the flexible member 18. In one particular embodiment, the entirety of the releasable connector 20 will be on an opposite side of the longitudinal axis 16 in the flexed second position. When the flexible member 18 is in the flexed second position, the first surface 28 of the flexible member is convexly curved and the second surface 30 of the flexible member is concavely curved.

A bracket 62 may secure the flexible member 18 to the pole handle 22. The bracket 62 may be substantially rigid member that is relatively inflexible compared to the flexible member 18. The bracket may be a U-shaped member including two flanges that define a slot 76 therebetween. More particularly, a first flange 64 has an inner surface 66 and an outer surface 68, and a second flange 70 has an inner surface 72 and an outer surface 74. The first and second flanges 64, 70 may be generally parallel to each other such that the inner surface 66 of the first flange 64 faces the inner surface 72 of the second flange 70 to collectively define the slot 76. The first and second flanges 64, 70 extend longitudinally from respective first and second ends. The longitudinal axis 16 extends centrally between the first and second flanges 64, 70. A proximal endwall or end flange 78 extends transversely through the longitudinal axis 16 to connect the second end of the first flange 64 with the second end of the second flange 70. The height (or other dimension) of the slot is defined between inner surface 66 of the first flange 64 to the inner surface 72 of the second flange 70. The slot 76 height is complementary to the height or thickness 38 of the flexible member 18.

Each flange 64, 70 may be a trapezoid-shaped plate having rounded corners. More particularly, the first flange 64 and the second flange 70 may each include a distal edge 80 that defines its first end that is offset orthogonal to the longitudinal axis 16. Side edges 82, 84 flare or taper outwardly as the trapezoid-shaped plate extends toward a rigid connection the proximal endwall 78. The width of the trapezoid-shaped plate at the distal edge approximates the width 40 of the flexible member 18 between the first sidewall 32 and the second sidewall 34. The width of the trapezoid-shaped plate at its proximal second end adjacent the proximal endwall 78 of the bracket is greater than the width 40 of the flexible member 18. In one particular embodiment, the width of the bracket 62 at its proximal end is in a range from about 1.5 times to about 2.5 times greater than the width of the bracket at the distal edge 80. In one particular embodiment, the length of the bracket 62 measured between endwall 78 and edge 80 is less than half the length 36 of flexible member 18 which may ensure that the member 18 is sufficiently long to reduce shear stress to reduce the likelihood of the member 18 from breaking or rupturing during normal operation.

The second end 26 of the flexible member 18 is retained within the slot 76 between the inner surface 66 of the first flange 64 and the inner surface 72 of the second flange 70. The first surface 28 of the flexible member directly abuts or directly contacts the inner surface 66 of the first flange 64. The second surface 30 of the flexible member 18 directly abuts or directly contacts the inner surface 72 of the second flange 70. The flexible member 18 may be connected to the bracket via any known mechanical manner, chemical manner, or non-mechanical and non-chemical manner. In one particular embodiment, two mechanical connectors 86, such as a nut and bolt, can be utilized to extend through the first and second flanges 64, 70 and the flexible member 18 to effectuate the connection of the flexible member 18. In this scenario, the mechanical connectors 86 extend transversely through the longitudinal axis 16 within the second half 60 of the flexible member 18 (i.e., proximal relative to the imaginary vertical midline). The first end 24 of flexible member 18 extends outwardly from the bracket 62 in a cantilevered manner such that the first end 24 of the flexible member 18 and the releasable connector 20 are distal from and not retained within the slot 76.

The proximal endwall 78 of the bracket 62 is rigidly connected with the pole handle 22. More particularly, the proximal endwall 78 of the bracket 62 is connected with a distal first end 88 of the pole handle 22. The pole handle 22 includes a body 90 that extends linearly from the distal first end 88 to a proximal second end 92. The body 90 may be in the shape of an elongated tube or cylinder. The body 90 of the pole handle 22 may be hollow along a length thereof in order to reduce weight. The body 90 may include a cylindrical convex outer surface 94 opposite a concave inner surface that defines the hollow interior of the body 90. The hollow interior of the pole handle may be centered along the longitudinal axis 16. The length 98 of the pole handle measured from its distal first end 88 to its proximal second end 92 may be in a range from about one foot to about four feet. In the figures, the length of body 90 is depicted with broken lines 96 that indicate that the pole handle is not drawn to scale such that first end 88 and the second end 92 can be viewed collectively in one figure. The range of the handle length 98 may be advantageous in some scenarios to ensure that the handle 22 is long enough to reach the roof surface to place the insulation plate 23 while an operator is in an upright standing/walking position while being short enough to ensure that the operator can manually manipulate the pole handle 22 with one hand to pick up one plate from a plurality of insulation plates 23 held in the other hand of the operator. Further, while the cylindrical body 90 of the pole handle 22 is shown as having a fixed length, other embodiments may provide a telescopic body for the pole handle may be selectively varied in length to provide a length-adjustable pole handle.

A grip 100 may be applied or otherwise connected to pole handle 22. The grip 100 may be disposed adjacent the proximal second end 90 and circumscribe the exterior convex surface 94 of the body 90. The grip 100 may be texturized to ergonomically enhance grasping of the grip by an operator and provide comfort as well. The grip 100 may be a lightweight foam-based material in one embodiment. However, other grips are entirely possible such as those that circumferentially wrap around the exterior surface of the body of the pole handle.

FIG. 4-FIG. 8 diagrammatically depict the operation of hand tool 10 for placing insulation plates 23 on a roof 102, which may be flat or have a low slope. The insulation plates 23 are provided in a plurality, wherein the plurality of plates 23 is shown as 104. Often a roofer or operator will gather the plurality 104 insulation plates 23 and hold them in his hand while retaining additional insulation plates on his person, such as in his person or in a tool belt or pocket.

Figure 5:
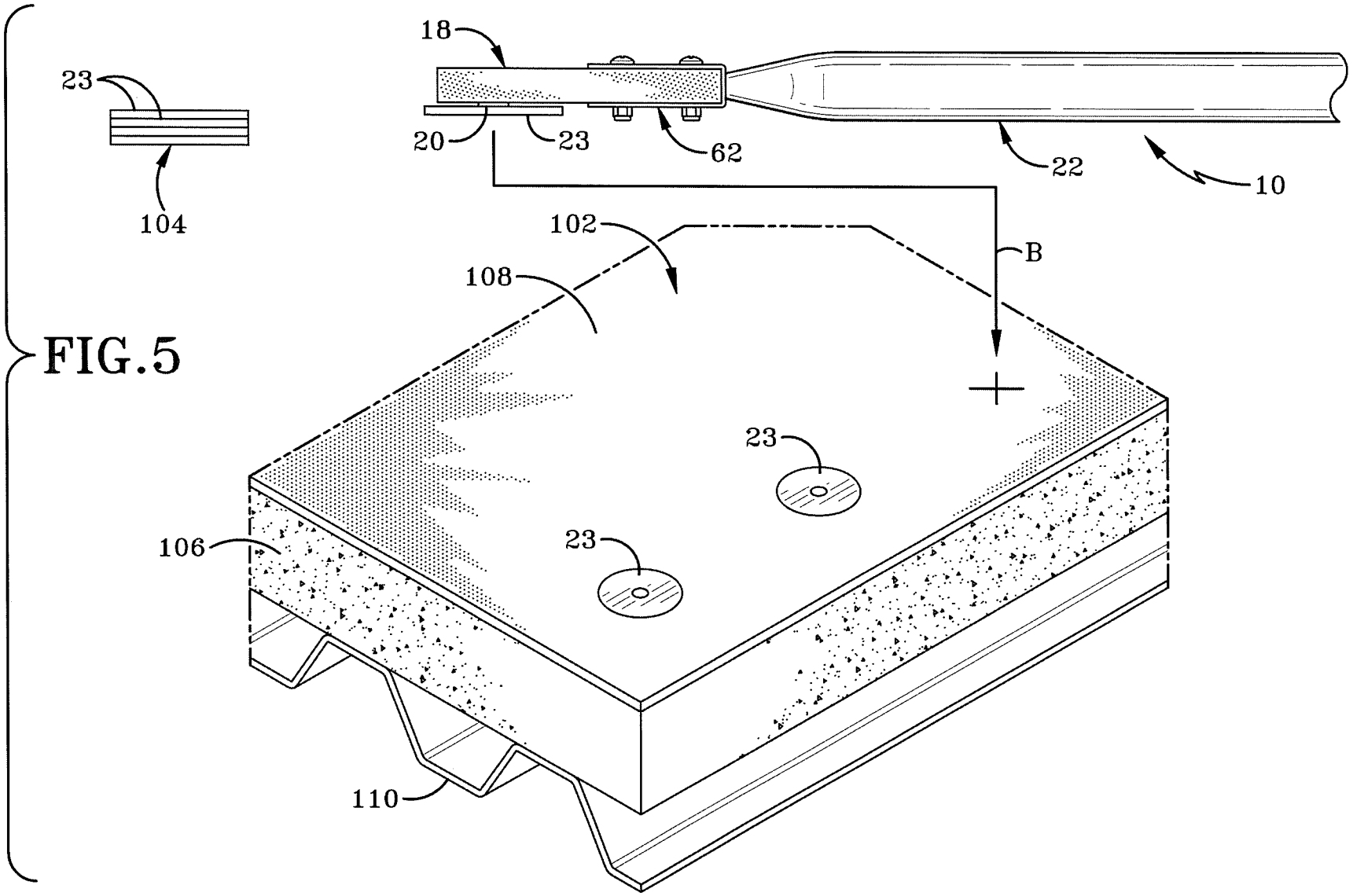
FIG. 5 (FIG. 5) is a diagrammatic view of the hand tool carrying one insulation plate that will be placed on a flat or low slope roof.

The insulation plates 23 are to be placed either atop the foam board insulation 106 or atop the vapor barrier or membrane 108 depending on which round of construction the roof is underway. FIG. 5 diagrammatically depicts the second round underway in which the foam board 106 has already been secured with insulation plates the corrugated metal 110 and now the vapor barrier or membrane 108 is being secured to the foam board 106 insulation. Some insulation plates 23 are shown as already having been placed on the vapor barrier or membrane 108 and the next location for one insulation plate 23 to be placed is indicated by an X.

The releasable connector 20 secures one insulation plate from the plurality 104 of insulation plates 23 to the flexible member 18 as indicated by Arrow A. For a right-handed roofer, the roofer handling the hand tool 10 will grasp the grip 100 in their right hand and hold a plurality 104 of insulation plates 23 in his left hand. The roofer, grasping the grip 100, maneuvers the releasable connector 20 over the plurality 104 of plates 23 in his left hand and contacts the releasable connector 20 to the major surface of the insulation plate 23 adjacent its center. The releasable connector 20 retains one insulation plate 23. As the roofer moves the flexible member 18 away from the plurality 104 of insulation plates, which are often stacked, the grip strength of the releasable connector 20 ensures that only one insulation plate 23 at a time is picked up by the releasable connector 20 and leaving the remaining plurality 104 of plates stacked in the roofer's left hand.

As depicted by FIG. 5, the one insulation plate 23 carried by the flexible member 18 is maneuvered toward the desired placement location, represented by the X, and as indicated by Arrow B. The operator is able to maneuver the insulation plate 23 with the hand tool 10 to the desired placement location while being able to stand and walk along the roof 102. This is effectuated by the length 98 of the pole handle 22. Thus, the hand tool 10 enables the manual installation and placement of insulation plates 23 on the roof 102 while eliminating the need for the roofer the crawl on their hands and knees to install/place the same.

Figure 6:
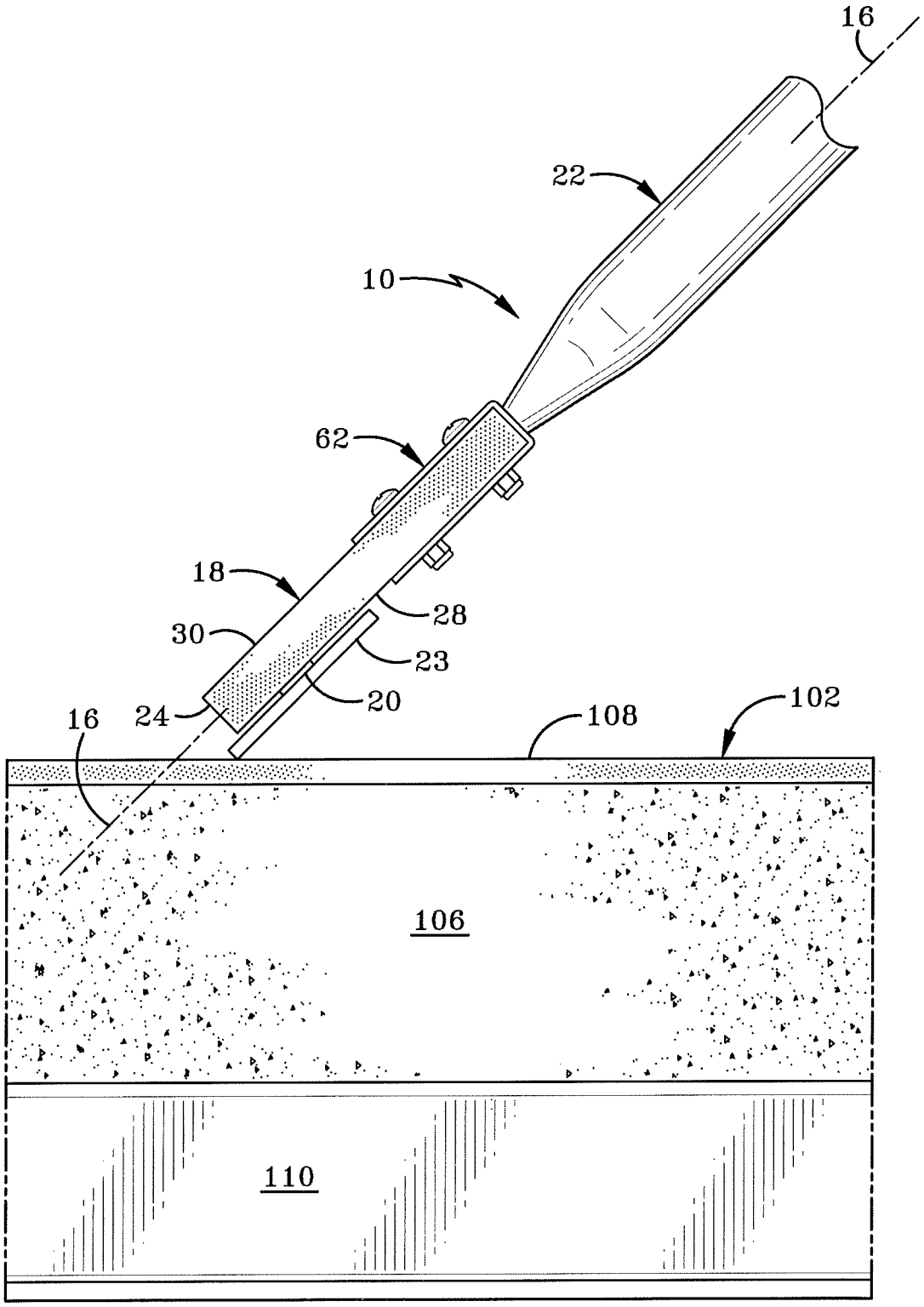
FIG. 6 (FIG. 6) is an operational diagrammatic view of the hand tool carrying one insulation plate that is to be placed on a flat or low slope roof and the flexible member in a neutral first position.
Figure 8:
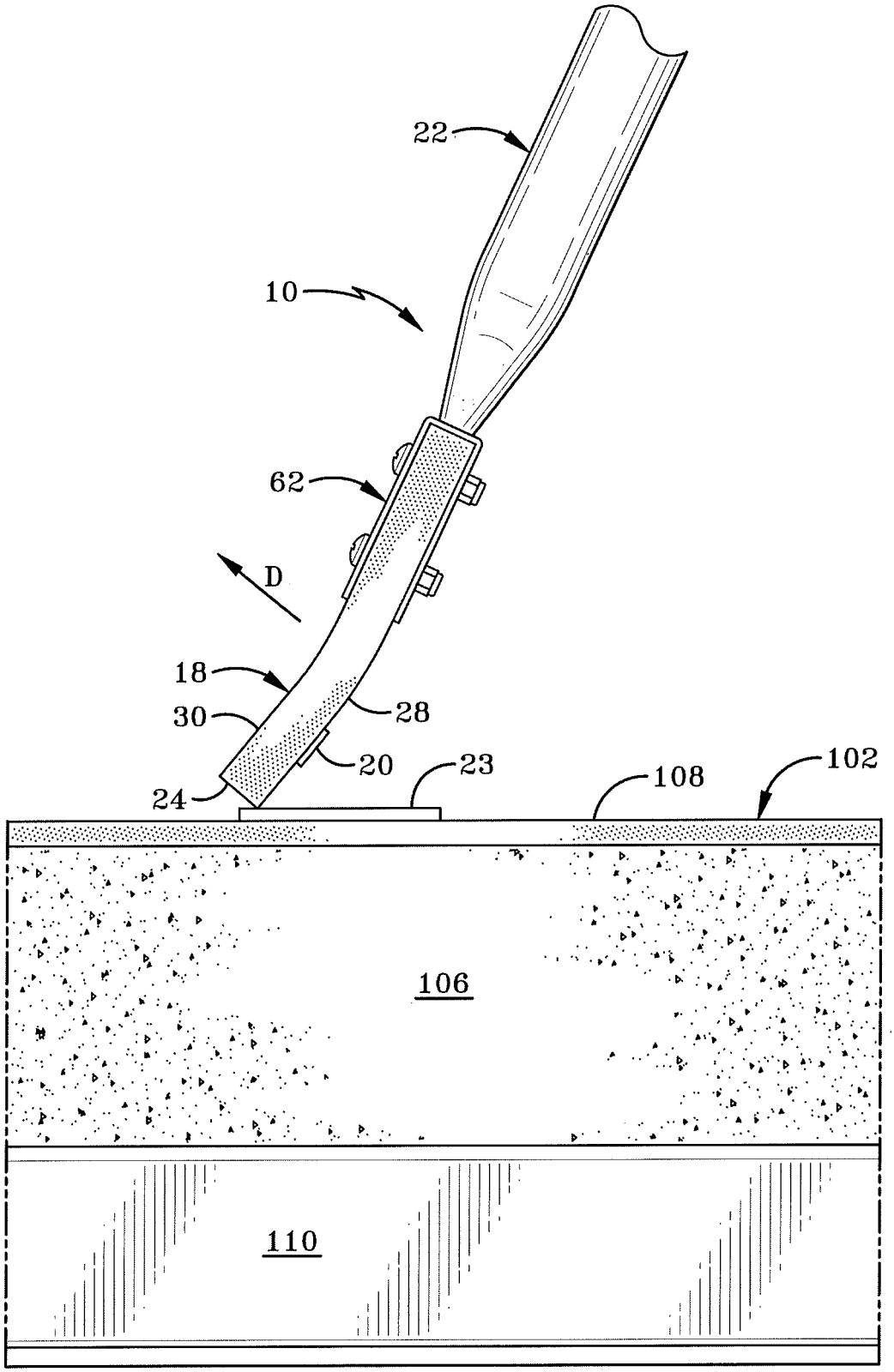
FIG. 8 (FIG. 8) is an operational diagrammatic view of the hand tool having placed one insulation plate on a flat or low slope roof and the flexible member returning from the flexed second position back to the neutral first position.

FIG. 6-FIG. 8 depict the placement of one insulation plate 23 in the desired location X. The hand tool 10 is maneuvered such that the longitudinal axis 16 is oriented at an angle in a range from about 15 degrees to about 60 degrees relative to the portion of the roof surface that the insulation plate is being placed (i.e., either the foam board 106 insulation of the vapor barrier 108). The first end 24 or the first surface 28 of the flexible member 18 directly contacts the roof surface. Further, depending on the location of the releasable connector 20 relative to the length the flexible member 18, an outer circumferential edge of the insulation plate 23 may contact the roof surface. During this maneuver, the Shore A hardness of the material forming the flexible member 18 ensures that the flexible member 18 remains linear and straight. Stated otherwise, the weight of the insulation plate 23 carried by the releasable connector 20 on the flexible member 18 will not cause the flexible member 18 to bend or flex.

FIG. 7 depicts that to flex or bend the flexible member, the pole handle 22 is raise upwardly in the direction of Arrow C while the first surface 28 of the flexible member 18 maintains contact with the roof surface. This upward force imparted to the pole handle 22 causes the flexible member 18 to flex or bend. This may be considered the flex direction associated with the flexible member. The flexion causes the flexible member 18 to flex from its neutral first position towards its flexed second position. During flexion, the first surface 28 is caused to have a convex surface and the second surface 30 is caused to have a concave surface. Notably, and as shown in the figures, the handle 22 remains relatively straight or rigid relative to the flex direction of the flexible member. Further, the flex direction refers to the flex direction of the flexible member during placement of the plate 23. Thus, since member 18 is flexible, there may be other directions that member 18 may flex or bend, but accordingly to one embodiment the flex direction is the direction that member 18 flexes during placement of the plate 23.

The flexion of the flexible member 18 causes the releasable connector 20 to release its connection with the one insulation plate 23. The insulation plate 23 is thereby placed in its desired location X on the roof. The hand tool 10 may be lifted in its entirety as indicated by Arrow D (FIG. 8) and the Shore A hardness of the material forming the flexible member causes the flexible member to resiliently return to its neutral first position.

Thereafter, the roofer may move to the next location to place another insulation plate 23 atop the roof and repeat the process of placing a single insulation plate 23 while standing or walking along the roof and not having to crawl on his knees to the next placement location.

Figure 9:
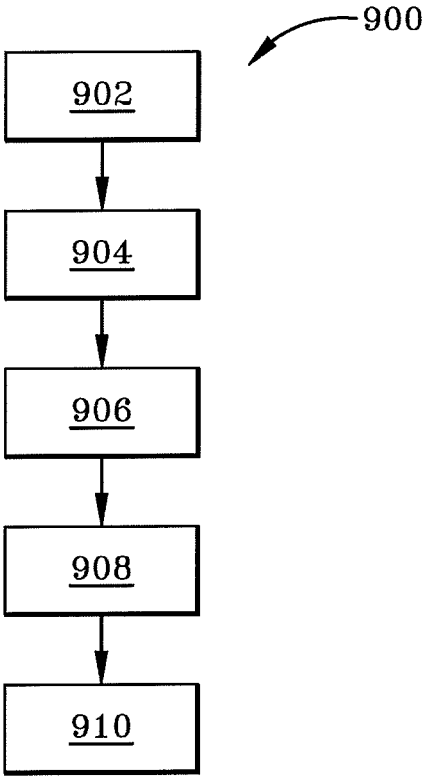
FIG. 9 (FIG. 9) is a flow chart depicting an exemplary method in accordance with one aspect of the present disclosure.

In addition to the above-described method of operation, FIG. 9 depicts a flow chart of a method in accordance with another embodiment of the present disclosure generally at 900. Method 900 provides a method of placing an insulation plate in a desired location with a hand tool. Method 900 includes connecting an insulation plate to a releasable connector carried by a flexible member disposed adjacent a distal end of a handle that is rigid relative to the flex direction of the flexible member, which is shown generally at 902. Method 900 may also include moving the insulation plate adjacent a desired location that the insulation plate is to be placed, which is shown generally at 904. Method 900 may also include flexing the flexible member from a neutral first position to a flexed second position, which is shown generally at 906. Method 900 may also include releasing the insulation plate from the releasable connector, which is shown generally at 908. Method 900 may also include disposing the insulation plate in the desired location atop one of an insulation board and a vapor membrane on a flat or low slope roof, which is shown generally at 910.

Method 900 may further flexing the flexible member relative to a longitudinal axis of the hand tool to define a convex first surface and a concave second surface on the flexible member to release the insulation plate while the flexible member is in the flexed second position. Method 900 may further provide contacting the flexible member with the insulation board or the vapor membrane while flexing the flexible member; and disposing the releasable connector on an opposite side of the longitudinal axis in the flexed second position than when the flexible member is in the neutral first position. Method 900 may further provide lifting the flexible member away from the insulation board or the vapor member, wherein the material forming the flexible has a Shore A hardness in a range from about 30 to about 50 that resiliently returns the flexible member from the flexed second position to the neutral first position. Method 900 may further provide connecting the insulation plate to the flexible member via the releasable connector having a grip strength that exerts a connection force that is greater than a weight of the insulation plate but less than twice the weight of the insulation plate.

Figure 10:
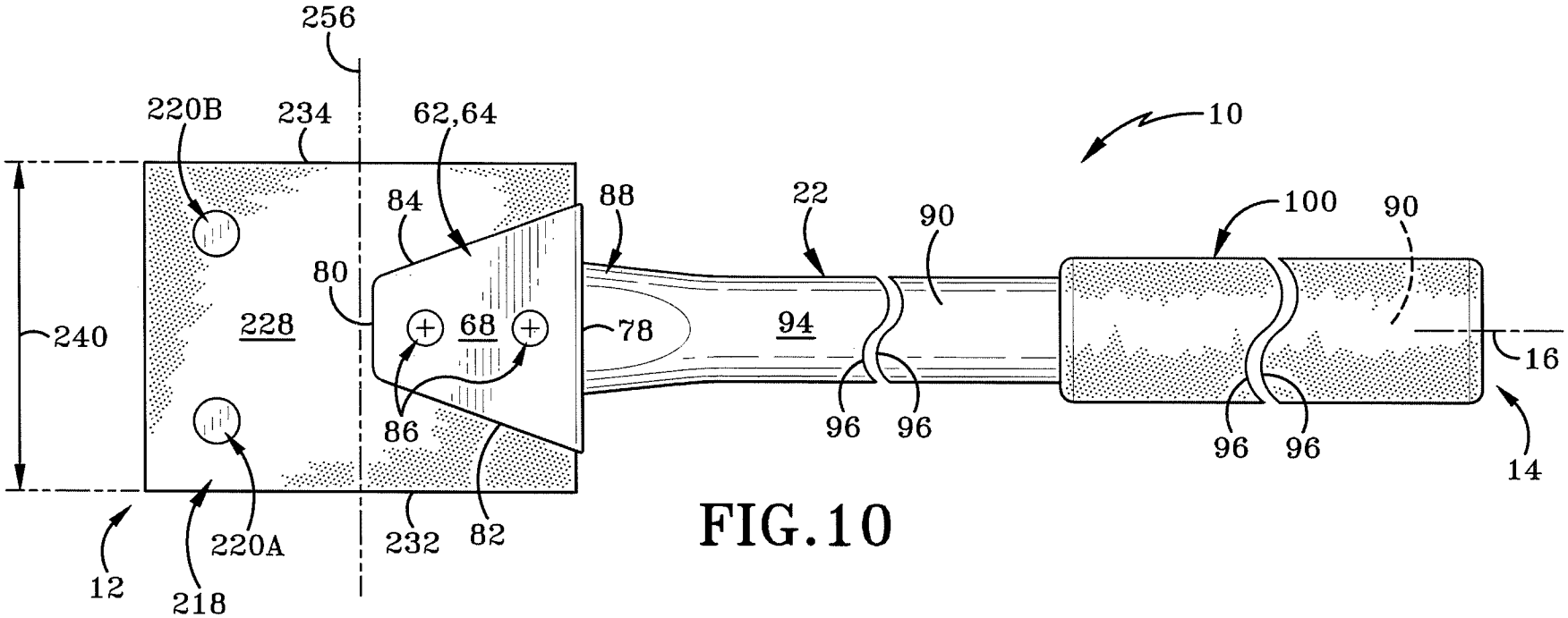
FIG. 10 (FIG. 10) is a bottom plan view of the hand tool for placing the insulation plate in accordance with the present disclosure having a second embodiment of a flexible member carrying at least two releasable connectors.

FIG. 10 depicts an alternative embodiment of the tool 10 having a widened flexible member 218 defining a width 240 measured between a first side 232 and a second side 240 that is greater than width 40 of the first flexible member 18. In one particular embodiment, width 240 is greater than the width associated with the maximum outer diameter of the first end 68 of the pole handle 22. Additionally, width 240 is greater than the width associated with the end wall 78 on the bracket 62. The enlarged flexible member 218 carries two releasable connectors rather than a single releasable connector. More particularly, a first releasable connection 220A may be embodied as a magnet and a second releasable connector 220B may be embodied as another magnet. Each of the magnets 220A, 220B may be at least partially embedded in the flexible member 218 in a manner similar to that which is provided in FIG. 3. However, the releasable connectors 220A, 220B do not lie along a plane central to the longitudinal axis 16 of the tool 10. In one particular embodiment, the first releasable connector 220A is located distally from the central axis 256 of the flexible member 218 and is offset to the first side 232 relative to longitudinal axis 16. Similarly, second releasable connector 220B is located distally from central axis 256 of flexible member 218 but is offset towards the second side 240 relative to the longitudinal axis 16. The embodiment of the flexible connector 218 having at least two releasable connectors 220A, 220B may further be modified to increase the number of releasable connectors as would be necessary to releasably connect with an insulation plate having a specific configuration that performs optimally with two or more releasable connectors or magnets. One exemplary insulation plate that works well with two releasable connectors 220A, 220B is an insulation plate manufactured by a company commercially selling a brand named Rhino Plates. These exemplary plates are substantially planar in cross section having only a slightly raised central portion around a central aperture. Thus, the overall flat portion of the plate may engage the two respective releasable connectors 220A, 220B on diametrically opposite sides of the central aperture of the insulation plate. The remaining portions of the tool 10 having a flexible member 218 would operate in a similar manner to that which is described above except that there would be two releasable connectors to releasably secure the insulation plate and lay the same onto the roof vapor barrier or membrane or to the insulation board as the case may be. Additionally, handle 22 may be generally rigid relative to the flex direction of flex member 218.

Also, various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, any method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. A method of placing an insulation plate in a desired location with a hand tool comprising:

connecting an insulation plate to a releasable connector carried by a flexible member disposed adjacent a distal end of an elongated handle that is generally rigid relative to a placement flexing direction of the flexible member;

moving the insulation plate adjacent a desired location that the insulation plate is to be placed on a flat or low slope roof;

flexing the flexible member from a neutral first position to a flexed second position, wherein the flexible member has a longitudinal axis in the neutral first position;

releasing the insulation plate from the releasable connector; and disposing the insulation plate in the desired location atop one of an insulation board and a vapor membrane on the flat or low slope roof.

2. The method of claim 1, further comprising:

wherein the releasable connector is offset to one side of the longitudinal axis when the flexible member is in the neutral first position and wherein the releasable connector intersects the longitudinal axis as the flexible member flexes from the neutral first position towards the flexed second position.

3. The method of claim 2, wherein the releasable connector is offset to an opposite side of the longitudinal axis in the flexed second position.

4. The method of claim 1, further comprising:

flexing the flexible member relative to the longitudinal axis to define a convex first surface when the insulation plate is release from the releasable connector and the flexible member is in the flexed second position.

5. The method of claim 4, further comprising:

flexing the flexible member relative to the longitudinal axis to define a concave second surface when the insulation plate is release from the releasable connector and the flexible member is in the flexed second position.

6. The method of claim 4, further comprising:

contacting the flexible member with the insulation board or the vapor membrane while flexing the flexible member; and disposing the releasable connector on an opposite side of the longitudinal axis in the flexed second position than when the flexible member is in the neutral first position.

7. The method of claim 6, further comprising:

lifting the flexible member away from the insulation board or the vapor member, wherein the material forming the flexible has a Shore A hardness in a range from about 30 to about 50 that resiliently returns the flexible member from the flexed second position to the neutral first position.

8. The method of claim 1, further comprising:

connecting the insulation plate to the flexible member via the releasable connector having a grip strength that exerts a connection force that is greater than a weight of the insulation plate but less than twice the weight of the insulation plate.

9. The method of claim 1, further comprising:

connecting the insulation plate to the flexible member via the releasable connector having a grip strength that exerts a connection force that is greater than about 14 grams and less than about 30 grams.

10. The method of claim 1, wherein the releasable connector is a magnet, and connecting an insulation plate to a releasable connector is accomplished by the magnet.

11. The method of claim 10, further comprising:

precluding a rigidity of the magnet from inhibiting operation of the flexible member.

12. The method of claim 1, further comprising:

providing a pole handle coupled to the flexible member, wherein both the flexible member and the pole handle extending centrally along the longitudinal axis.

13. The method of claim 12, further comprising:

imparting force through the pole handle to effectuate the flexing of the flexible member.

14. The method of claim 1, further comprising:

effecting the flexible member to return to the neutral first position from the flexed second position after moving the pole handle away from the flat or low slop roof upon which the insulation plate has been placed.

15. The method of claim 1, further comprising:

orienting the longitudinal axis at an at an angle in a range from about 15 degrees to about 60 degrees relative to a major surface area of the flat or low slope roof.

16. The method of claim 15, further comprising:

contacting one of (i) a first end of the flexible member and (ii) an outer circumferential edge of the insulation plate with the flat or low slope roof;

effecting the flexible member to remain linear along the longitudinal axis until the flexing begins.

17. The method of claim 16, further comprising:

raising an end of a pole handle upwardly away from the flat or low slope roof to cause the flexible member to flex from the neutral first position towards the flexed second position;

maintaining contact of the one of (i) the first end of the flexible member and (ii) the outer circumferential edge of the insulation plate with the flat or low slope roof while the end of the pole handle is raised upwardly.

18. A method for placing an object on a flat or low slope roof comprising:

coupling an object, the object having an at least partially flat bottom, to a flexible member disposed adjacent an end of a handle, wherein the flexible member has a flexing direction, and wherein the flexible member has a longitudinal axis in a neutral first position;

moving the object adjacent a desired location that the object is to be placed on a flat or low slope roof;

flexing the flexible member from the neutral first position to a flexed second position, wherein the at least partially flat bottom of the object is offset to one side of the longitudinal axis when the flexible member is in the neutral first position and wherein the at least partially flat bottom of the object intersects the longitudinal axis as the flexible member flexes from the neutral first position towards the flexed second position;

releasing the object from the flexible member; and disposing the object in the desired location atop the flat or low slope roof.

* * * * *